US006152649A

United States Patent [19]

Snyder et al.

[11] Patent Number: 6,152,649

[45] Date of Patent: Nov. 28, 2000

[54] FUMES COLLECTION FOR AN AUGER-TYPE DISTRIBUTING DEVICE ON AN ASPHALT PAVER

[75] Inventors: Craig L. Snyder, Glenn Gardner, N.J.; Leland J. Warren, Humboldt, Ill.; Leonard E. Speers; Thomas A. Roth, both of Lerna, Ill.; Larry Craig, Mattoon, Ill.

[73] Assignee: Blaw-Know Construction Equipment Corp., Mattoon, Ill.

[21] Appl. No.: 09/374,863

[22] Filed: Aug. 16, 1999

Related U.S. Application Data

[60] Provisional application No. 60/098,193, Aug. 27, 1998.

[51] Int. Cl.[7] ..... E01C 19/18

[52] U.S. Cl. ..... 404/101; 404/108

[58] Field of Search ..... 404/101, 108, 404/83

[56] References Cited

U.S. PATENT DOCUMENTS

| | | | |
|---|---|---|---|
| 4,012,160 | 3/1977 | Parker | 404/84.05 |
| 4,749,304 | 6/1988 | Craig . | |
| 5,002,426 | 3/1991 | Brown et al. . | |
| 5,443,325 | 8/1995 | Simonelli et al. | 404/75 |
| 5,531,542 | 7/1996 | Willis . | |
| 5,938,371 | 8/1999 | Gustin et al. | 404/108 |

FOREIGN PATENT DOCUMENTS

WO 99/14436 3/1999 WIPO .

*Primary Examiner*—James A. Lisehora
*Attorney, Agent, or Firm*—Mark A. Ussai

[57] ABSTRACT

A pneumatic fumes collection system for an auger-type distributing device that spreads hot asphalt behind a mobile paver includes a rotatable auger shaft extending horizontally above a surface being paved and laterally to a longitudinal centerline axis of the paver. The shaft includes a plurality of auger flights spaced therealong, and can be raised and lowered to a plurality of elevations above the surface being paved. A fumes intake inlet is positioned above, and in a fixed spacial relation to, the auger shaft, whereby the fumes inlet raises and lowers simultaneously with the auger shaft, resulting in an a more uniform fumes collection over a plurality of auger flight elevations. A fumes exhaust fan and exhaust stack are positioned on the paver.

9 Claims, 6 Drawing Sheets

FUMES COLLECTION FOR AN AUGER-TYPE DISTRIBUTING DEVICE ON AN ASPHALT PAVER

This application claims the benefit of U.S. Provisional Application Ser. No. 60/098,193 filed Aug. 27, 1998.

BACKGROUND OF THE INVENTION

This invention relates generally to asphalt pavers, and more particularly to fumes collection devices used to collect fumes emanating from asphalt around an auger-type distributing device.

Conventional fumes collection devices include hoods suspended over an auger-type distributing device. Such hoods include large members that extend above the auger flights, blocking the operator's view of the asphalt as it is being spread. This blocking makes it very difficult for the operator to monitor the properties of the asphalt, and to take prompt, corrective action, should the asphalt quality so-require.

Also, during operation, it becomes necessary to raise the auger flights to a plurality of elevations above the surface being paved. Conventional hoods do not raise and lower, precisely along with the augers, resulting in a condition wherein the auger flights may move upward closer to the hood, when the auger is raised, and further away from the hood when the auger is lowered. This variability of auger/hood relation results in the fumes exhaust system operating in a variable degree of efficiency. When the auger is too close to the hood, fine particles can be drawn into the exhaust system, causing damage thereto. When the auger is to far away from the hood, the exhaust system does not collect all the fumes that it should.

The foregoing illustrates limitations known to exist in present fumes collection systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fumes collection system for an auger-type distributing device that spreads hot asphalt behind a mobile paver, the distributing device being attached to a rear chassis member of the machine, the distributing device including a rotatable auger shaft extending horizontally above a surface being paved, the auger shaft extending laterally transverse to a longitudinal axis of the machine, the auger shaft carrying a plurality of auger flights spaced therealong above the surface; the distributing device including means for raising and lowering the auger shaft and the auger flights to a plurality of elevations above the surface; the improvement comprising: a pneumatic fumes collection system on the vehicle having intake means positioned in a fixed relation above the auger shaft for collecting and venting away fumes emanating from the asphalt adjacent to the auger flights; and means for raising and lowering the intake means simultaneously with the auger flights, whereby the fumes collection system collects fumes to a uniform degree at a plurality of auger flight elevational positions.

BRIEF DESCRIPTION OF THE DRAWING FIGURES

DETAILED DESCRIPTION

Figure 1:
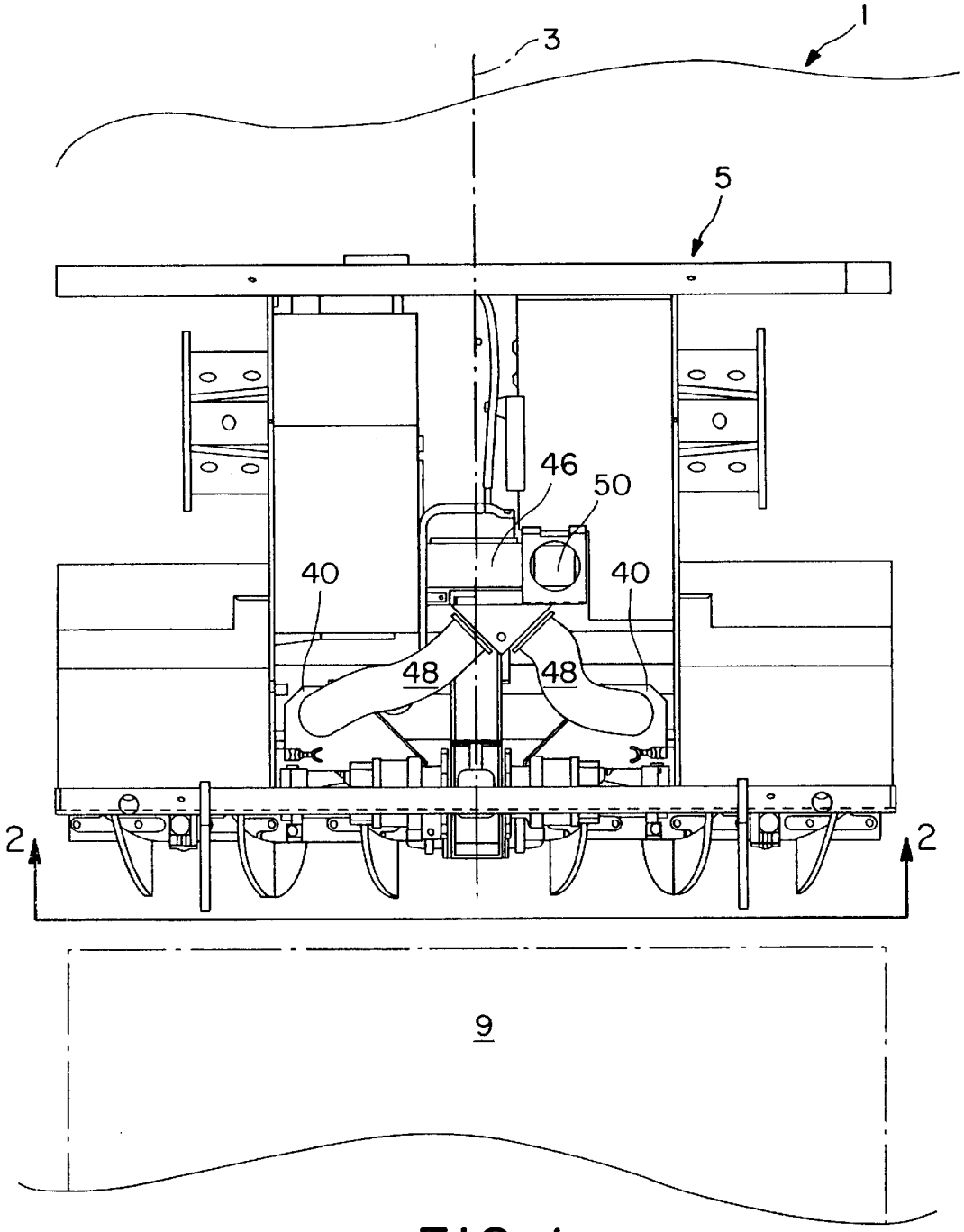
FIG. 1 is a schematic top plan view of a paver, with parts removed, having the fumes collection system of the invention thereon.
Figure 2:
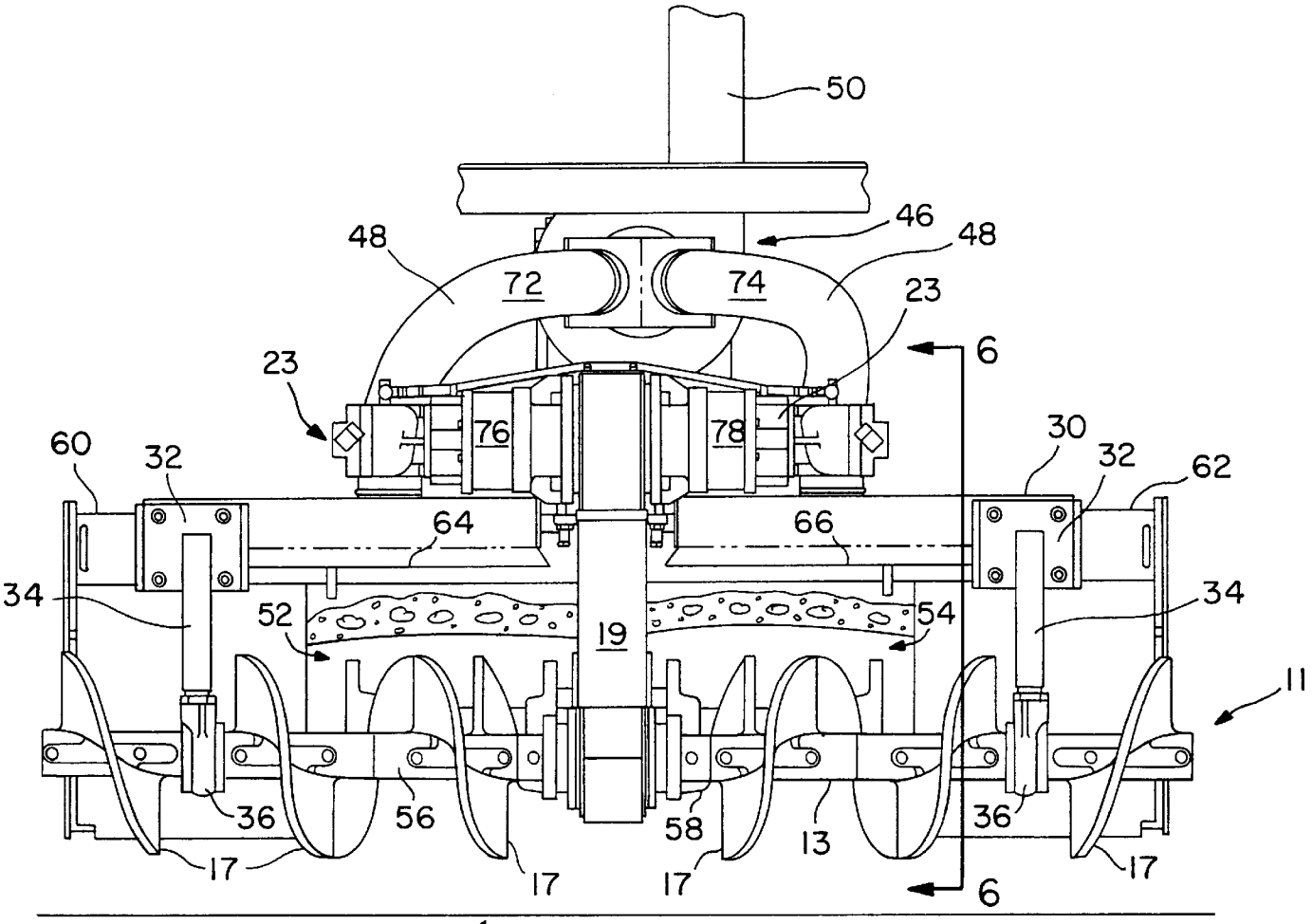
FIG. 2 is a view along 2—2 of FIG. 1.
Figure 3:
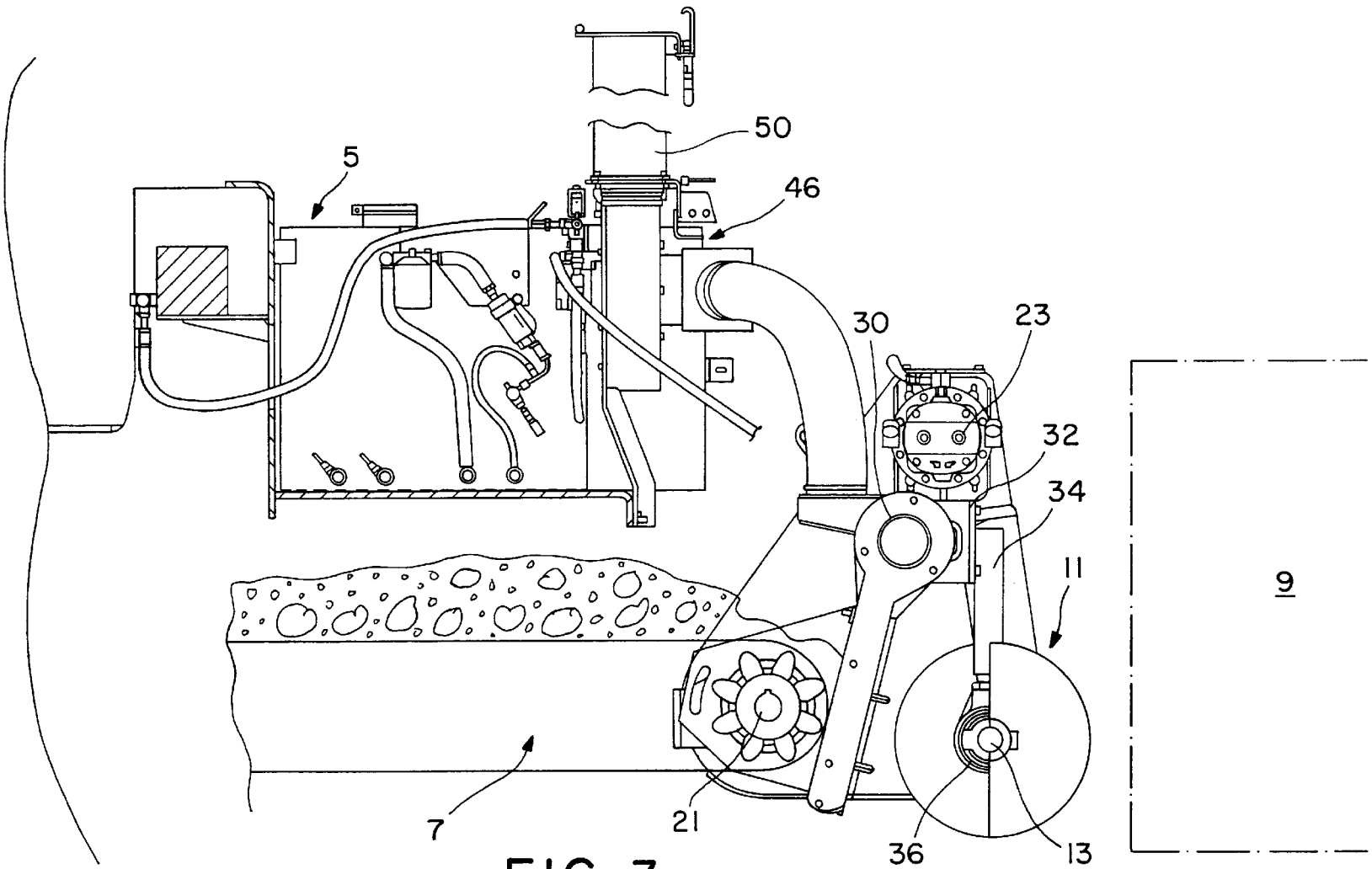
FIG. 3 is a schematic side elevational view of the invention, with parts removed.

Now referring to FIGS. 1–3 there is shown a conventional paver 1 having a longitudinal centerline axis 3 and a rear chassis portion 5. Paver 1 includes a conventional continuous, slat-type conveyor means 7 for conveying hot asphalt rearward, depositing it at the back of paver 1 as shown in FIG. 3. A power extendable screed (shown in phantom)9 is attached to the paver 1, the screed 9 having a center section and opposite left and right extendable sections (not shown), as is well known.

Directly in front of the screed 9 is an auger-like distributing device 11 of the invention. Asphalt is deposited in front of the distributing device 11 and is moved laterally outwardly to the extremities of the screed 9. The distributing device 11 includes a rotatable auger shaft 13 extending horizontally above a surface being paved 15. Auger shaft 13 extends laterally transverse to longitudinal center axis 3 of paver 1, with auger shaft 13 carrying a plurality of auger flights 17 spaced therealong above surface 15.

Figure 4:
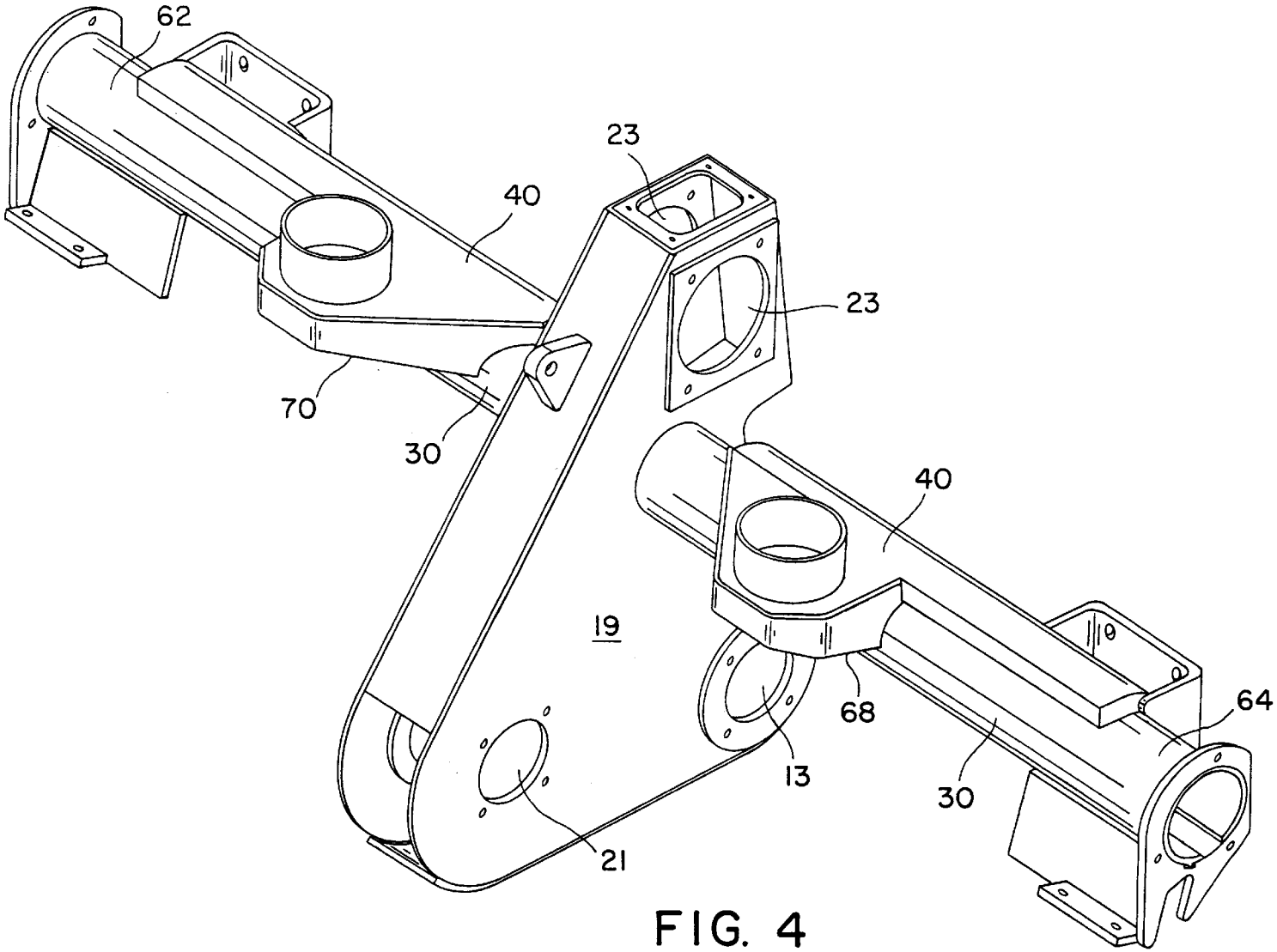
FIG. 4 is a schematic perspective view of an auger chain drive box assembly, with parts removed, showing the left and right fumes collection hoods of the invention.
Figure 6:
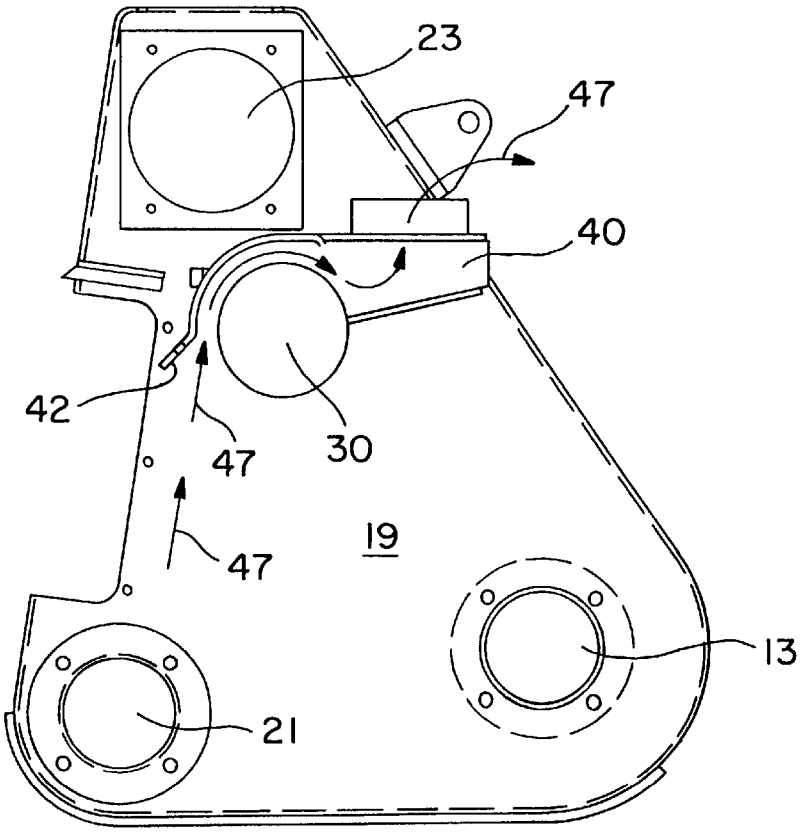
FIG. 6 is a view along 6—6 of FIG. 2, with parts removed, showing a typical fumes flow path into a fumes inlet opening and fumes collection hood of the invention.
Figure 7:
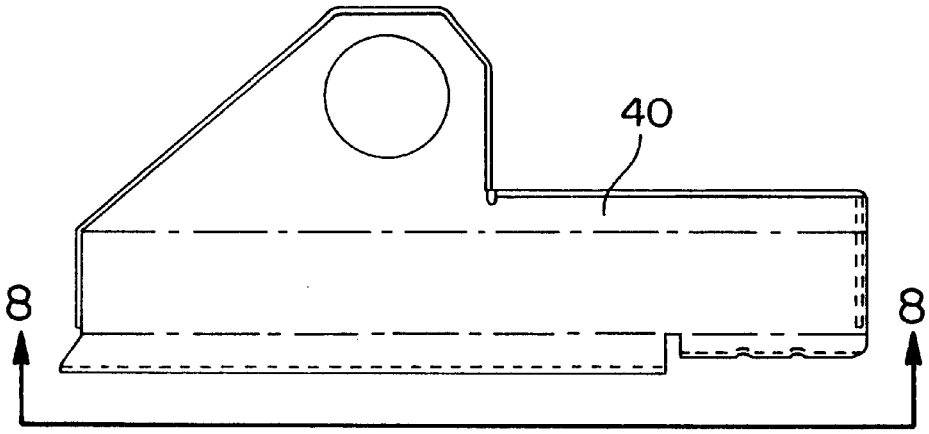
FIG. 7 Is a schematic top plan view of a right side fumes collection hood of the invention.
Figure 8:
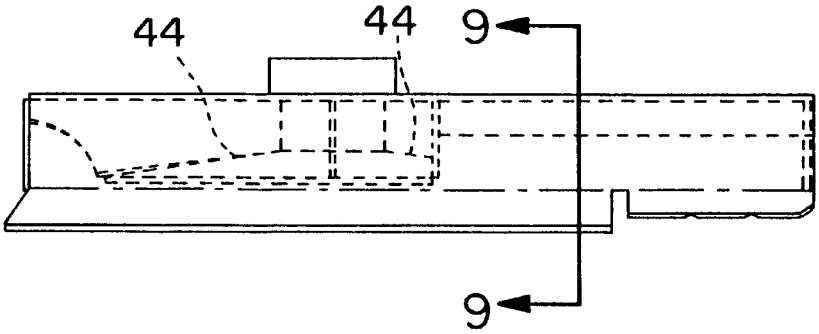
FIG. 8 is a view along 8—8 of FIG. 7, showing internal baffles in the collection hood.
Figure 9:
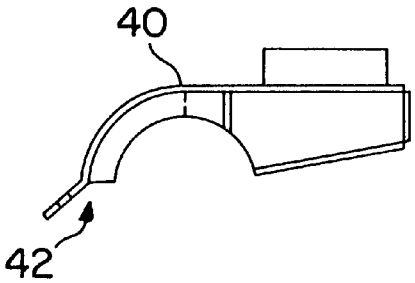
FIG. 9 is a schematic view along 9—9 of FIG. 8.

As shown in FIGS. 2,4 and 6, conveyor 7 is driven by a chain box drive assembly 19, of conventional design, rotatably connected to a conveyor shaft 21 at a rearward end of conveyor 7. Chain box drive assembly 19 also rotatably drives auger shaft 13, as is well known, via conventional drive motors and planetary gear box shown generally as 23.

Figure 5:
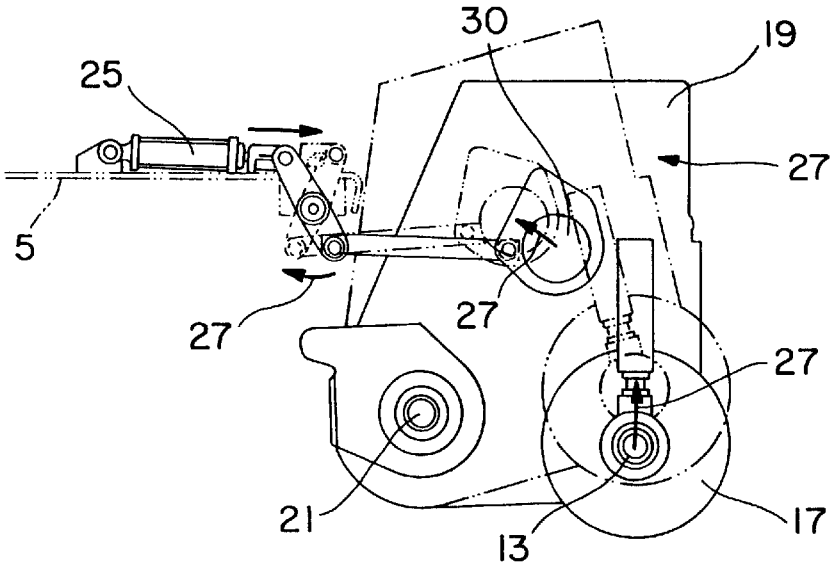
FIG. 5 is a schematic side elevational view of an auger lift cylinder assembly for raising and lowering the auger of the invention, with the auger shown in phantom in the raised position.

FIG. 5 illustrates the preferred means for raising and lowering auger shaft 13 and auger flights 17, as is required from time to time in the operation of the paver 1. Hydraulic auger lift cylinder 25 is pivotally connected to chain box drive assembly 19 on a first end and to a rear chassis member 5 on a second end. Reciprocation of cylinder 25 raises and lowers auger shaft 13 and auger flights 17 (as shown by arrows 27) by pivoting around conveyor axis shaft 21.

As shown in FIGS. 2, 3 and 4, upper support member 30 for auger shaft 13 is also carried by chain box drive assembly 19 on tubular arms extending laterally from drive box 19. Upper support member 30 is positioned above and substantially parallel to auger shaft 13. Auger support bearing hangers 32 carry downwardly extending support arms 34 that support auger shaft 13 rotatably in bearings 36 therein. Upper support member 30 is preferably a hollow, tubular member with support arms (not shown) telescoped therein for extending and supporting an extension of auger shaft 13, when distributing device 11 is extended.

The fumes collection system of the invention is shown more detail in FIGS. 4–9. A fumes collection hood 40 is welded to upper support member 30 around perimeter surfaces of hood 40. Hood 40 is thereby pneumatically sealed onto support member 30, but leaving a fumes intake inlet opening 42 oriented toward auger flights 17 (FIG. 6). Inlet opening 42 extends laterally transverse to longitudinal axis 3 and substantially parallel to auger shaft 13 a transverse distance that is substantially the same as auger shaft 13. Hood 40 contains a plurality of internal baffles 44, of convenient design to promote uniform flow through hood 40 and generally through exhaust fan means 46. FIG. 6 illustrates the flow path (arrows 47) via inlet opening 42 and hood 40.

As shown in FIGS. 1–3, the fumes collection system of the invention further comprises exhaust fan means 46 on chassis 5 for drawing fumes into intake opening 42 and hood 40. Flexible duct means 48 connect exhaust fan means 46 and hood 40. A vertical exhaust stack 50 vents fumes away from the paver 1.

We prefer to provide certain portions of the fumes collection system of this invention as a pair of left and right, independent subassemblies, as shown in FIG. 2. This is accomplished by positioning chain box drive assembly 19 at longitudinal center axis 3 of paver 1, with chain box drive assembly 19 having a left and right side oriented with respect to center axis 3, when viewed from the rear of paver 1. The conveyor means 7 is a pair of separate, left and right conveyors 52,54 connected to the left and right sides, respectively, of chain box drive assembly 19 and driven thereby. Auger shaft 13 of the distributing device 11 is a pair of separate, left and right shafts 56,58 connected to left and right sides, respectively, of chain box drive assembly 19 and driven thereby. Upper support member 30 is, preferably, a single continuous tubular member that extends through drive box assembly 19, but it could be provided as a pair of separate, left and right support members 60,62 connected to left and right sides, respectively, of chain box drive assembly 19. Fumes intake means 42 is a pair of separate, left and right intake means 64, 66 connected, respectively to left and right support members 60, 62. Fumes collection hood assembly 40 is a pair of separate, left and right fumes collection hoods 68, 70 connected, respectively to left and right support members 60, 62. Flexible duct means 48 are a pair of separate, left and right ducts 72, 74 connected, respectively, to the left and right fumes collection hoods 68, 70 on a first end and to the exhaust means 46 on a second end. Drive fans and planetary gear box 23 combined are a pair of separate, left and right fan and gear box combinations 76,78 connected to chain drive box assembly 19.

It will be understood that, with the intake means inlet opening 42 being in a fixed relation with respect to auger shaft 13, when auger shaft 13 is raised and lowered, intake means inlet opening 42 simultaneously raise and lower, maintaining the fixed relation with auger shaft 13. This condition results in a more uniform fumes collection and removal operation over a plurality of auger flight elevations. For a paver used for paving eight foot widths, we have found that the system works well with a centrifugal exhaust fan having a rated air flow (free blowing of 1300 cfm at 3450 rpm, and air flow under system operating conditions of 850 cfm. Because the invention operates more uniformly over a range of auger flight elevations than prior art devices, the invention can use a smaller fan, an economic advantage. Prior art systems for the same size paver required a fan having a rated air flow (free blowing) of 2000 cfm at 3450 rpm and air flow under system operating conditions of 1075 cfm.

Because the fumes intake means 42 of the invention is compact and positioned on the upper support member 30, visibility of the auger flights 17 is improved over prior art systems, making possible improved operator control over asphalt quality.

Having described the invention, what is claimed is:

1. A fumes collection system for an auger-type distributing device that spreads hot asphalt behind a mobile paver comprising:

a. means for attaching to a rear chassis member of said machine a rotatable auger shaft extending horizontally above a surface being paved, said auger shaft extending laterally transverse to a longitudinal center axis of said machine, said auger shaft carrying a plurality of auger flights spaced therealong above said surface;

b. means for raising and lowering said auger shaft and said auger flights to a plurality of elevations above said surface;

c. a pneumatic fumes collection system on said vehicle having fumes intake means positioned above and in a fixed relation to said auger shaft for collecting and venting away fumes emanating from said asphalt adjacent to said auger flights; and d. means for raising and lowering said intake means simultaneously with said auger flights, whereby said fumes collection system collects fumes to a substantially uniform degree at a plurality of auger flight elevational positions.

2. The fumes collection system of claim 1 wherein said means for attaching said auger shaft to said chassis member further comprises:

a. conveyor means carried on said chassis for feeding asphalt to said auger assembly over a continuous conveyor belt, said conveyor means having a rearward end extending around a rotatable conveyor shaft adjacent to said auger assembly;

b. chain box drive assembly means rotatably connected to said conveyor shaft and to said auger shaft for rotatably driving said conveyor and said auger shaft; and c. upper support member means carried by said chain box drive means assembly, said support member means spaced above said auger shaft, said support member extending laterally transverse to said longitudinal axis and substantially parallel to said auger shaft and to a transverse distance substantially the same as said auger shaft.

3. The fumes collection system of claim 2 wherein said means for raising and lowering said auger shaft and said auger flights to a plurality of elevations above said surface comprises: auger lift cylinder means pivotally connected between said chain box drive assembly and said chassis for reciprocating back and forth to pivot said chain box drive assembly around said conveyor shaft, whereby said auger flights and said upper support member are raised and lowered.

4. The fumes collection system of claim 3 wherein said fumes collection system further comprises: said intake means being attached to said upper support member, said intake means having an inlet opening oriented toward said auger flights and extending substantially a distance the same as said upper support member transverse distance, whereby said intake means moves up and down simultaneously with said auger flights.

5. The fumes collection system of claim 4 further comprising:

a. exhaust fan means on said chassis for drawing asphalt fumes into said intake means;

b. flexible duct means connecting said exhaust fan means and said intake means; and c. exhaust stack means on said chassis for exhausting said fumes away from said machine.

6. The fumes collection system of claim 5 further comprising: a fumes collection hood assembly fastened to said upper support member for collecting fumes, said fumes collection hood assembly being in pneumatic communication with said intake means and said exhaust means.

7. The fumes collection system of claim 6 further comprising:

a. said chain box drive assembly being positioned at said longitudinal center axis of said machine, said chain box drive assembly having a left and right side oriented with respect to said center axis;

b. said conveyor means being a pair of separate left and right conveyors connected to said left and right sides, respectively, of said chain box drive assembly and driven thereby;

c. said auger shaft of said distributing device being a pair of separate left and right shafts connected to said left and right sides, respectively, of said chain box drive assembly and driven thereby;

d. said upper support member means being a pair of separate left and right support members connected to said left and right sides, respectively, of said chain box drive assembly;

e. said fumes intake means being a pair of separate left and right intake means connected, respectively to said left and right support members;

f. said fumes collection hood assembly being a pair of separate left and right fumes collection hoods connected, respectively to said left and right support members; and g. said flexible duct means being a pair of separate left and right ducts connected, respectively, to said left and right fumes collection hoods on a first end and to said exhaust means on a second end.

8. The fumes collection system of claim 7 wherein said distributing device auger axis is laterally extendable to a plurality of widths, and said upper support member supporting said auger axis when so extended.

9. In a fumes collection system for an auger-type distributing device that spreads hot asphalt behind a mobile paver, said distributing device being attached to a rear chassis member of said paver, said distributing device including a rotatable auger shaft extending horizontally above a surface being paved, said auger shaft extending laterally transverse to a longitudinal axis of said paver, said auger shaft carrying a plurality of auger flights spaced therealong above said surface; said distributing device including means for raising and lowering said auger shaft and said auger flights to a plurality of elevations above said surface; the improvement comprising:

a. a pneumatic fumes collection system on said vehicle having intake means positioned in a fixed relation above said auger shaft for collecting and venting away fumes emanating from said asphalt adjacent to said auger flights; and b. means for raising and lowering said intake means simultaneously with said auger flights, whereby said fumes collection system collects fumes to a uniform degree at a plurality of auger flights elevational positions.

* * * * *